United States Patent [19]

Ando

[11] Patent Number: 5,075,676

[45] Date of Patent: Dec. 24, 1991

[54] LCD CONTROL DEVICE

[75] Inventor: Kunihiro Ando, Tokyo, Japan

[73] Assignee: Clarion Co., Ltd., Tokyo, Japan

[21] Appl. No.: 450,904

[22] Filed: Dec. 13, 1989

[30] Foreign Application Priority Data

Dec. 14, 1988 [JP] Japan ..... 63-315691

[51] Int. Cl.[5] ..... G09G 3/18

[52] U.S. Cl. ..... 340/765; 340/752

[58] Field of Search ..... 350/332, 331 R; 340/763, 765, 756, 752

[56] References Cited

U.S. PATENT DOCUMENTS

| | | | |
|---|---|---|---|
| 3,831,166 | 8/1974 | De Nardo | 340/765 |
| 3,961,840 | 6/1976 | Morokawa et al. | 340/765 |
| 4,380,371 | 4/1983 | Frantz | 350/332 |

*Primary Examiner*—Jeffery A. Brier

*Attorney, Agent, or Firm*—Flynn, Thiel, Boutell & Tanis

[57] ABSTRACT

A liquid crystal display control device uses first and second common signals supplied to two segments forming a pair in a liquid crystal display element to always generate four kinds of segment signals synchronizing with these two common signals and selectively supply one segment signal among them to the two segments to control their display operations.

4 Claims, 5 Drawing Sheets

LCD CONTROL DEVICE

BACKGROUND OF THE INVENTION

This invention relates to a device for controlling the display operation of an LCD, and more particularly to an LCD control device enabling controls of the display operation of the LCD by an external signal which does not synchronize with a COM signal which behaves as a reference of on-and-off operations of segments in the LCD.

DESCRIPTION OF THE PRIOR ART

Conventional LCD controls have been effected by a method shown in FIG. 5 in which a microcomputer 50 directly activates an LCD 52. More specifically, output terminals COM 1 and COM 2 of the microcomputer 50 output a COM 1 signal and a COM 2 signal shown in FIG. 6A, respectively, and an output terminal Seg outputs a segment signal shown in FIG. 6B. In the interior of the LCD 52 are provided a first segment 52*a* and a second segment 52*b* which form a pair. The COM 1 signal is supplied to the first segment 52*a*, the COM 2 signal to the second segment 52*b*, and the segment signal to both the first and the second segments. The COM 1 signal and the COM 2 signal behave as references of on-and-off operations of the first segment 52*a* and the second segment 52*b*, respectively, and each segment takes its light-on or light-off condition, depending on the potential difference from the segment signal of FIG. 6B. Although the on-and-off operation will be explained later in a greater detail, it is essential that the COM 1 signal and the COM 2 signal are synchronous with the segment signal, respectively. Therefore, in order to control the on-and-off operation of the LCD according to conditions of respective portions of the device, it is necessary to, as shown in FIG. 5, once enter signals from the respective portions as various external signals 51 in the microcomputer, subsequently process and judge them with a program established in the microcomputer 50, and thereafter output them as the segment signals synchronous with the COM 1 and COM 2 signals. When it is desired to change the on-and-off operation by the respective external signals 51 or to activate the on-and-off operation in response to other external signals, the conventional method requires changes of the program set in the microcomputer 50. Thus changes of the display mode by the LCD has influenced the software for controlling the entirety of the device as well. In other words, there has been a drawback that once a microcomputer for use in the device is selected, the LCD display is also limited, accordingly.

SUMMARY OF THE INVENTION

The invention has an object to overcome the above-indicated drawbacks of the conventional technology, and its subject matter is as follows:

a liquid crystal display control device comprising: liquid crystal display means having a first segment and a second segment; common signal generating means for supplying said first segment with a first common signal for use as a reference of the on-and-off operation of said first segment and for supplying said second segment with a second common signal for use as a reference of the on-and-off operation of said second segment; segment signal generating means supplied with said first and second common signals from said common signal generating means for always generating four kinds of signals in synchronization with said first and second common signals, said four kinds of segment signals being a total light-on signal for lighting on both said first and said second segments, a first segment light-on signal for lighting on said first segment alone, a second segment light-on signal for lighting on said second segment alone, and a total light-off signal for lighting off both said first and said second segments; and segment signal selecting means for selecting one of said four kinds of segment signals generated by said segment signal generating means and for supplying it to both said first and said second segments.

DETAILED DESCRIPTION OF PREFERRED EMBODIMENTS

Figure 1:
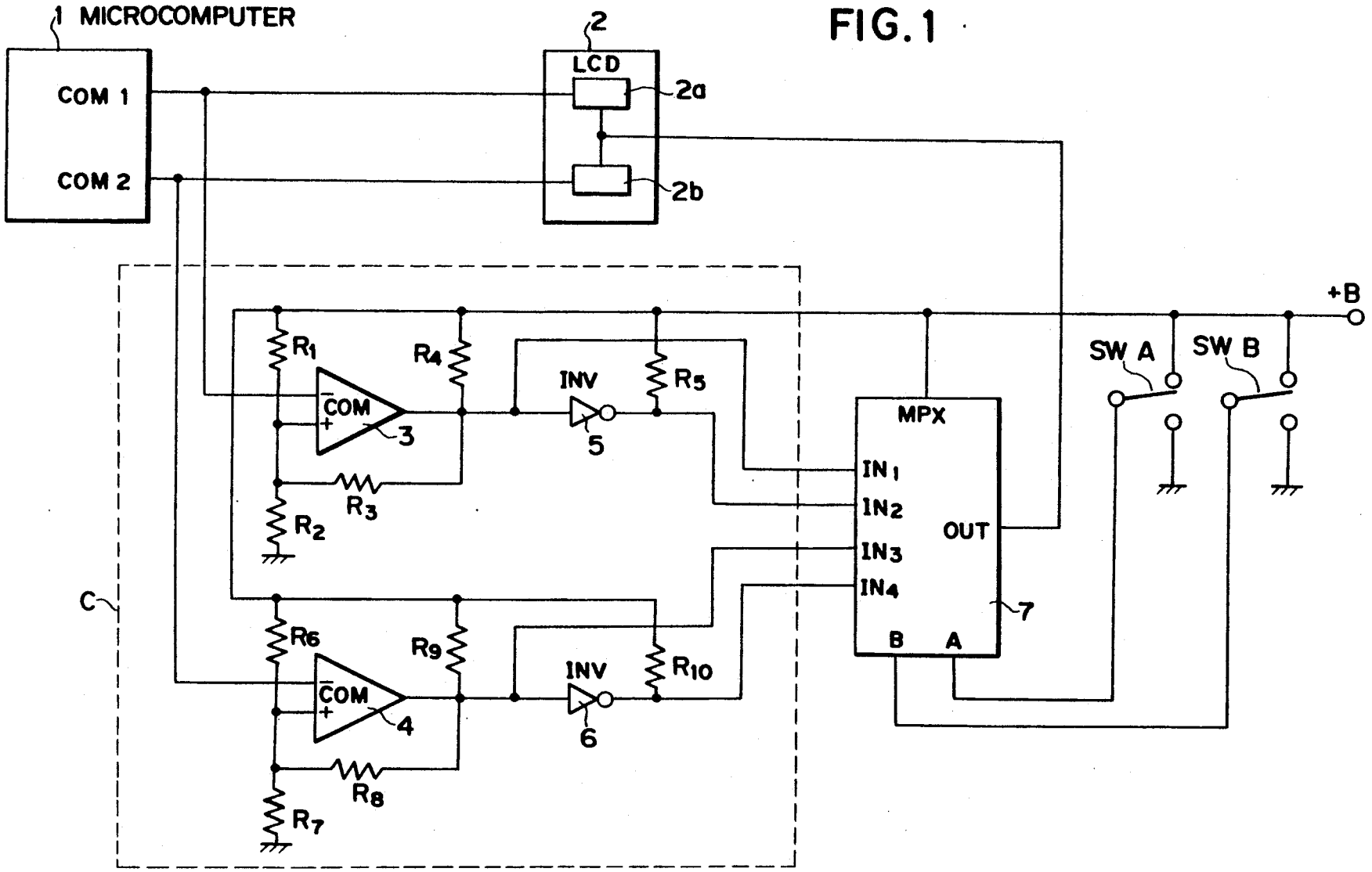
FIG. 1 is a block diagram showing an embodiment of the invention.

FIG. 1 is a block diagram of an embodiment of the invention. From two output terminals COM 1 and COM 2 of a microcomputer 1 are always outputted a COM 1 signal and a COM 2 signal (common signal=-COM signal) shown in FIG. 2. Evidently from the drawing, the COM 1 and COM 2 signals are each in the form of a stair which sequentially repeats three-step voltages of 0V, 2.5V and 5V, and they are different in phase. An LCD 2 has a first segment 2*a* and a second segment 2*b*. The COM 1 signal is inputted to the first segment 2*a*, and the COM 2 signal to the second segment 2*b*. Further, a segment signal outputted from an output OUT of a multiplexer 7 is supplied to both the first and the second segments. The COM 1 and COM 2 signals outputted from the microcomputer 1 are branched and supplied to minus input terminals of a first comparator 3 and a second comparator 4. These two comparators are of an invertible type, and are configured to output a Hi level (5V) signal when a voltage applied to their minus input terminals is lower than a reference voltage applied to their plus input terminals, and output a LOW level (0V) signal when the voltage is higher than the reference voltage. The first comparator 3 is made to have a hysteresis by resistors R1, R2, R3 and R4 disposed therearound. Particularly in this embodiment, the first comparator 3 is so designed that when the waveform of the COM 1 signal inputted to its minus input terminal rises, the reference voltage set in its plus input terminal represents 3.5V, and when the waveform of the COM 1 signal falls, the reference voltage represents 1.5V. More specifically, as shown in FIG. 3A, when the COM 1 signal is below 3.5V, the output signal of the first comparator is the Hi level, and when the COM 1 signal rises and exceeds 3.5V, the output signal of the first comparator falls to the Low level. When the COM 1 signal falls below 1.5V, the output of the first comparator changes to the Hi level. When the voltage applied to the minus input terminal of the first comparator 3 is represented by $V_{IN}$, and the outputted voltage b $V_{OUT}$, the hysteresis of the first comparator 3 is as shown in FIG. 3B. The aforegoing also applies to the second comparator 4 for which R6, R7, R8 and R9 are set so that it has the same hysteresis as the first comparator 3.

Figure 2:
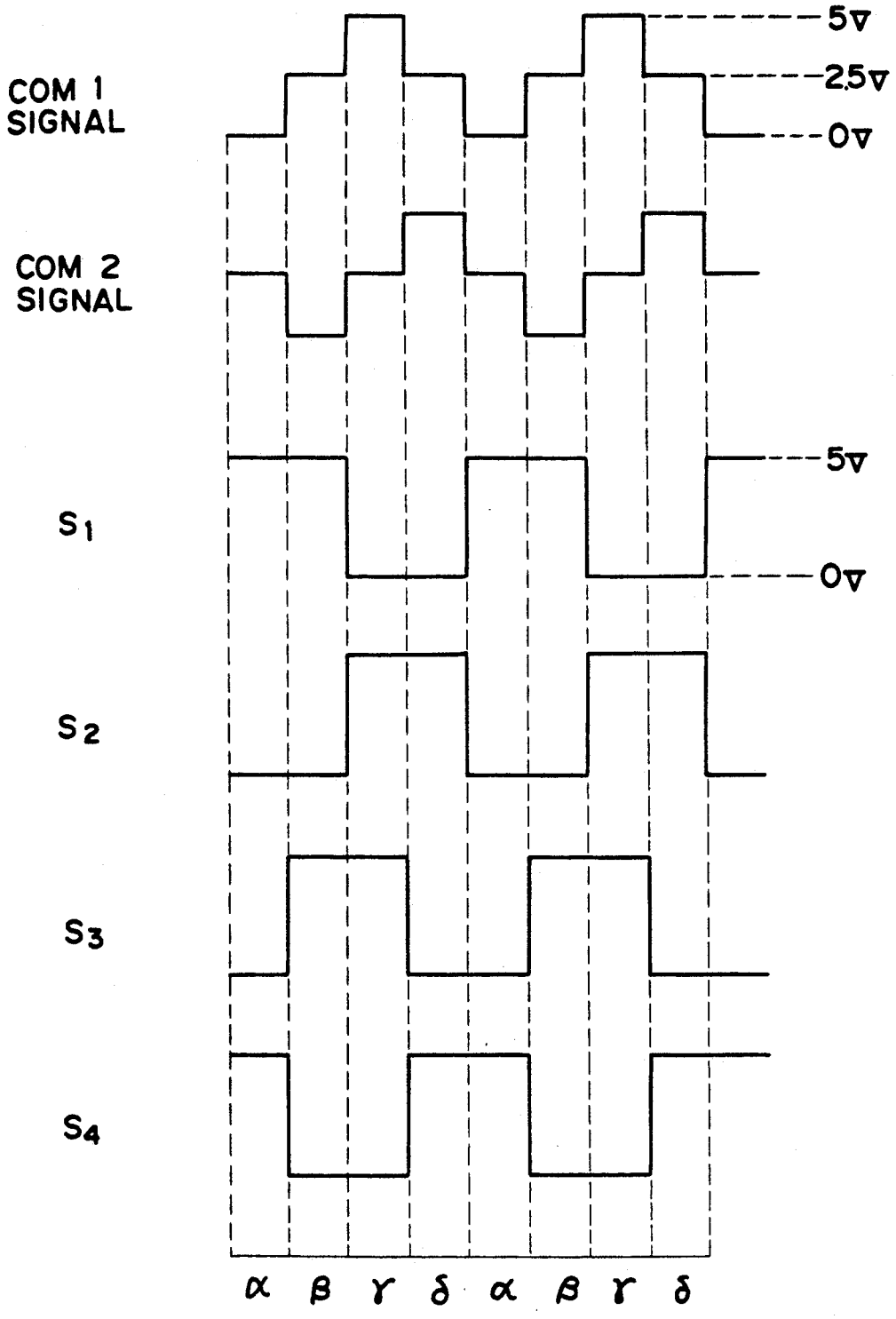
FIG. 2 is a timing chart showing LCD on-and-off control signals.
Figure 3A:
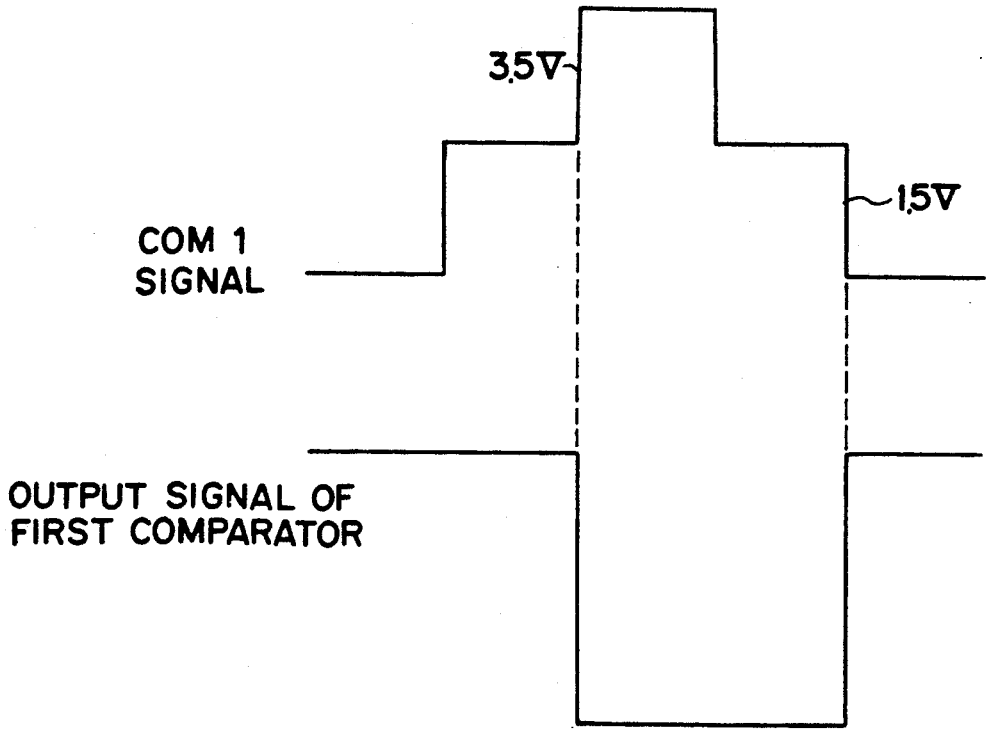
FIGS. 3A and 3B are views for explanation of the hysteresis which a comparator has.
Figure 3B:
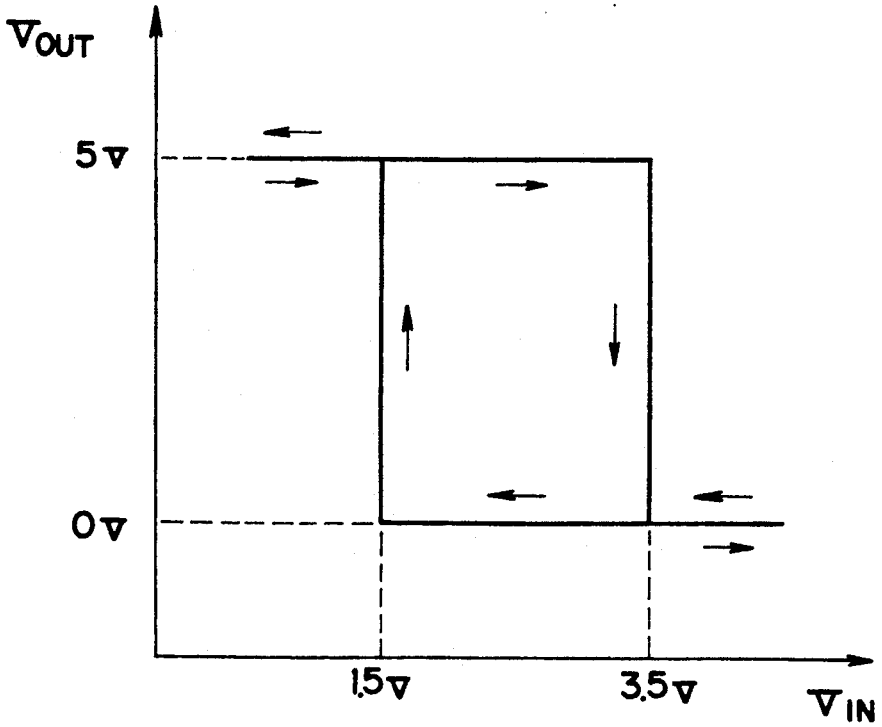

The first comparator 3 thus established converts the inputted COM 1 signal into a segment signal shown by S1 in FIG. 2. Similarly, the second comparator 4 converts the inputted COM 2 signal into a segment signal shown by S3. The output signal of the first comparator 3 is branched to two directions, and one of them is converted by a first inverter 5 into a segment signal shown by S2 in FIG. 2. Similarly, the output of the second comparator 2 is also branched to two directions, and one of them is converted by a second inverter 6 into a segment signal shown by S4. These segment signals S1 through S4 are entered in input terminals $IN_1$ through $IN_4$ of the multiplexer 7, respectively, and one of them is selected as the segment and supplied from the output terminal OUT to the first segment 2*a* and the second segment 2*b*.

Roles of the respective segment signals S1 to S4 are explained below. The respective segments 2*a* and 2*b* of the LCD 2 are designed to light on when the potential difference between the COM 1 or COM 2 signal supplied from the microcomputer 1 and the segment signal supplied from the multiplexer 7 reaches a predetermined value (5V in this embodiment). First reviewing the S1, its potential difference from the COM 1 signal is 5V in periods $\alpha$ and $\gamma$, and its potential difference from the COM 2 signal is 5V in periods $\beta$ and $\delta$. Thus two segments 2*a* and 2*b* appear to light on continuously due to the residual image effect, and it is noted that the S1 is a total light-on signal. Similarly reviewing the S2, its potential difference from the COM signal does not become 5V in all the periods $\alpha$ through $\delta$, and it is noted that the S2 is a total light-off signal. Regarding the S3, although the potential difference from the COM signal does not become 5V, its potential difference from the COM 2 signal becomes 5V in the periods $\beta$ and $\delta$, and the S3 is a second segment light-on signal which causes the second segment 2*b* alone to light on. In contrast, the S4 is a first segment light-on signal which causes the first segment alone to light on in the periods $\alpha$ and $\gamma$.

In this fashion, the multiplexer 7 is always supplied with four kinds of segment signals S1 to S4 from a segment signal generating means C, and to its input terminals A and B are entered signals from switches SWA and, SWB. These two switches SWA and SWB can take two different conditions, connected to a power source +B or connected to ground. The multiplexer 7 selects one of four segment signals S1 through S4, depending on four different combined conditions of two switches SWA and SWB, and outputs it from the output terminal OUT. Accordingly, the first segment 2*a* and the second segment 2*b* perform their display operations in response to the supplied segment signal.

As is clearly understood from the aforegoing description, it is two switches SWA and SWB in this embodiment that determine whichever display the LCD 2 does, and the microcomputer 1 merely continues to output the COM 1 and COM 2 signals and is not concerned with the determination at all. Therefore, free controls of the display operation of the LCD 2 is possible, without any changes in the program of the microcomputer 1. In other words, it is not necessary to replace the microcomputer by another in order to change or modify the display operation. The nature that the switches completely independent of the microcomputer 1 can control the LCD 2 is established by the arrangement where the segment signal generating means C uses the COM 1 and COM 2 signals and always generats four kinds of segment signals synchronous therewith. Signals from the exterior switches SWA and SWB merely determine whichever should be selected among the four kinds of segment signals, and they need not synchronize with the COM 1 and COM 2 signals at all.

Figure 4:
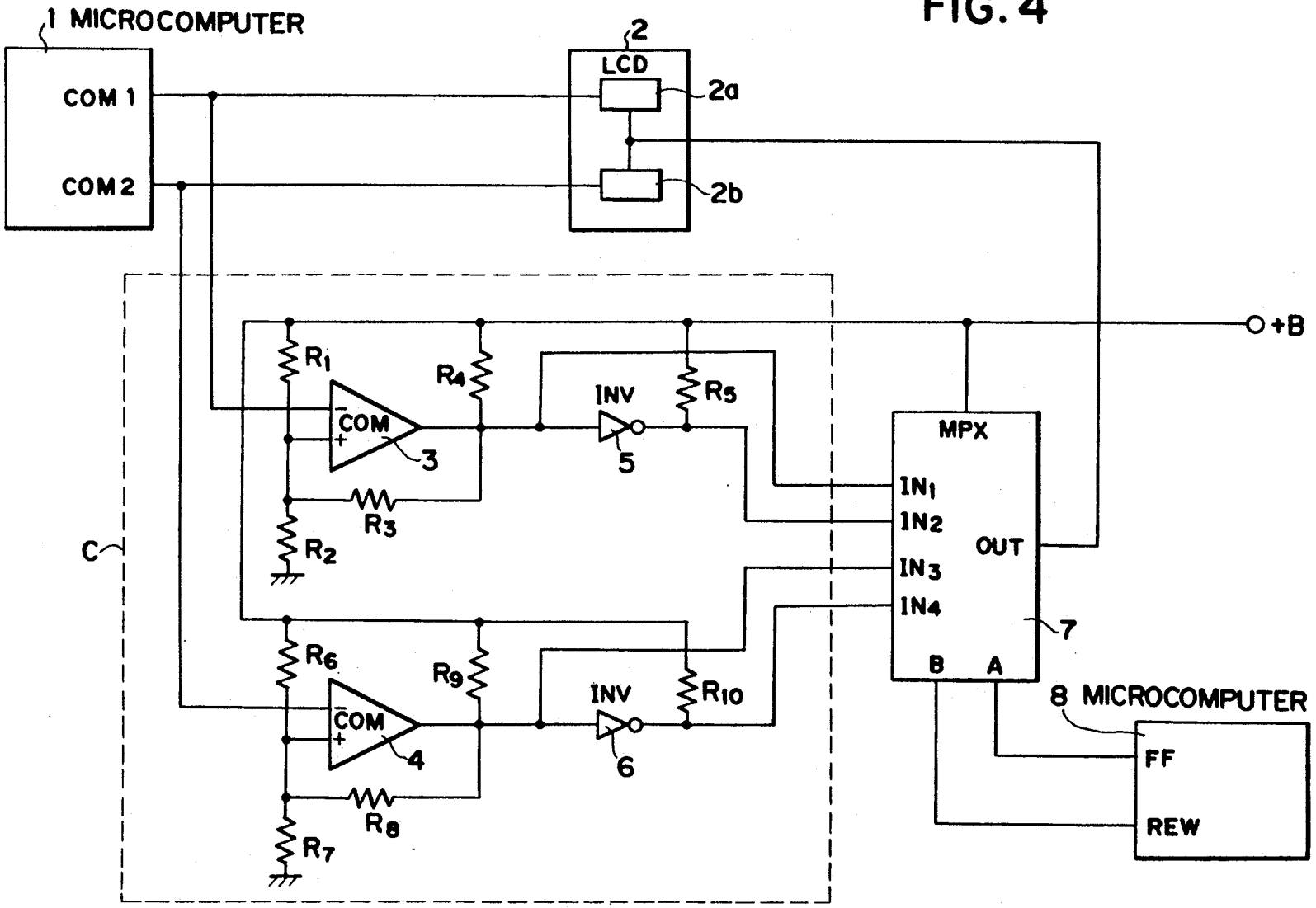
FIG. 4 is a block diagram showing a further embodiment of the invention.
Figure 5:
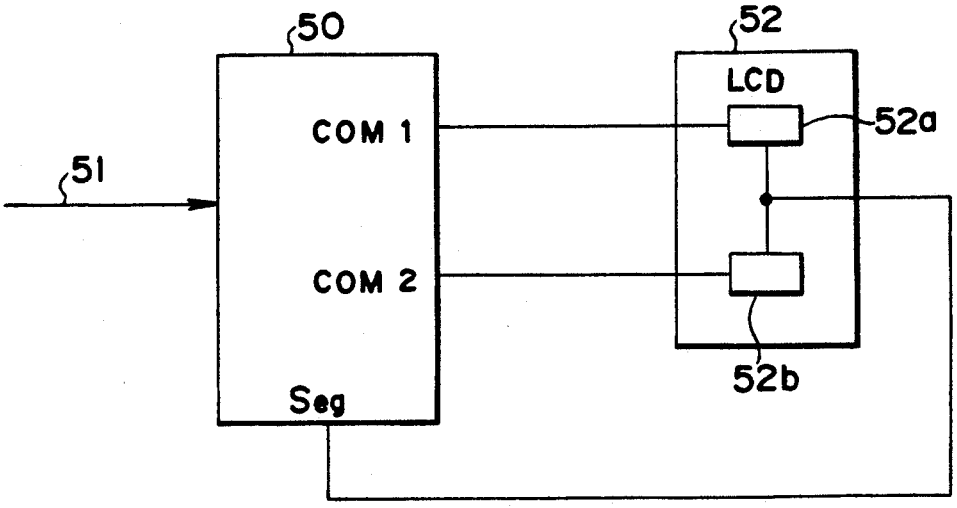
FIG. 5 PRIOR ART
FIG. 5 is a block diagram showing an existing technology.
Figure 6A:
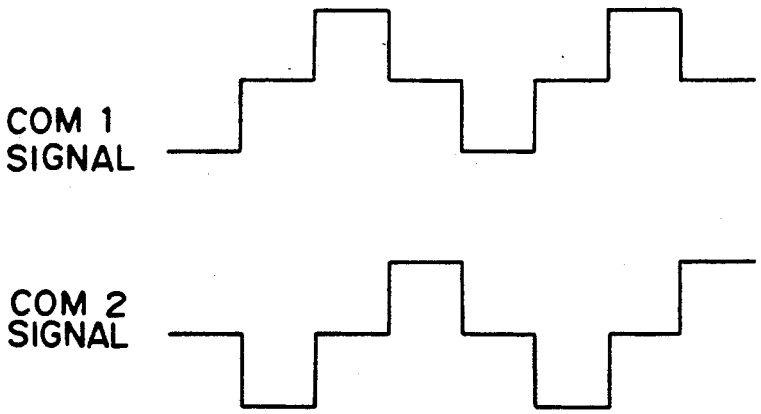
FIGS. 6A and 6B are views showing general LCD on-and-off control signals.
Figure 6B:
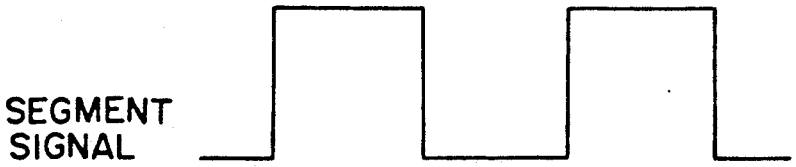

FIG. 4 shows another inventive LCD device taken as a second embodiment. This is different from the embodiment of FIG. 1 in that the mechanical switches SWA and SWB are replaced by a microcomputer 8 which controls driving mechanisms of a cassette tape recorder. In this embodiment, depending on combinations of signals supplied from two output terminals FF and REW of the microcomputer 8, selection of a segment signal by the multiplexer 7 is controlled.

What is claimed is:

1. A liquid crystal display control device comprising:
liquid crystal display means having a first segment and a second segment;
common signal generating means for supplying said first segment with a first common signal for use as a reference of the on-and-off operation of said first segment and for supplying said second segment with a second common signal for use as a reference of the on-and-off operation of said second segment;
segment signal generating means supplied with said first and second common signals from said common signal generating means for always generating four kinds of segment signals in synchronization with said first and second common signals, said four kinds of segment signals being a total light-on signal for lighting on both said first and said second segments, a first segment light-on signal for lighting on said first segment alone, a second segment light-on signal for lighting on said second segment alone, and a total light-off signal for lighting off both said first and said second segments;
segment signal selecting means for selecting one of said four kinds of segment signals generated by said segment signal generating means and for supplying it to both said first and second segments; and
wherein said segment signal generating means converts said first and second common signals into binary signals, respectively, by comparators, further branches each said binary signal to two directions, and, by inverting one of them, generates said four kinds of segment signals.

2. The liquid crystal display control device according to claim 1 wherein said first and second common signals are in the form of a stair sequentially repeating three-step voltages and are different from each other in phase.

3. The liquid crystal display control device according to claim 1 wherein said four kinds of segment signals are binary signals which alternatively repeat two-step voltage values.

4. A liquid crystal display control device comprising:
liquid crystal display means having a first segment and a second segment;
common signal generating means for supplying said first segment with a first common signal for use as a reference of the on-and-off operation of said first segment and for supplying said second segment with a second common signal for use as a reference of the on-and-off operation of said second segment;

segment signal generating means supplied with said first and second common signals from said common signal generating means for always generating four kinds of segment signals in synchronization with said first and second common signals, said four kinds of segment signals being a total light-on signal for lighting on both said first and said second segments, a first segment light-on signal for lighting on said first segment alone, a second segment light-on signal for lighting on said second segment alone, and a total light-off signal for turning off both said first and said second segments;

segment signal selecting means for selecting one of said four kinds of segment signals generated by said segment signal generating means and for supplying it to both said first and second segments; and wherein said segment signal generating means includes means for converting said first and second common signals into first and second binary signals, and means for inverting said first and second binary signals to respectively produce third and fourth binary signals, said first, second, third and fourth binary signals being said four kinds of segment signals.

* * * * *